US011118349B2

(12) United States Patent
Montoya et al.

(10) Patent No.: US 11,118,349 B2
(45) Date of Patent: Sep. 14, 2021

(54) RAFTER REINFORCEMENT BRACKET APPARATUS

(71) Applicants: Laura Montoya, Montgomery, TX (US); Samuel Montoya, Montgomery, TX (US)

(72) Inventors: Laura Montoya, Montgomery, TX (US); Samuel Montoya, Montgomery, TX (US)

( * ) Notice: Subject to any disclaimer, the term of this patent is extended or adjusted under 35 U.S.C. 154(b) by 50 days.

(21) Appl. No.: 16/776,191

(22) Filed: Jan. 29, 2020

(65) Prior Publication Data

US 2021/0230870 A1 Jul. 29, 2021

(51) Int. Cl.

| | |
|---|---|
| ***E04B 7/06*** | (2006.01) |
| ***E04B 7/02*** | (2006.01) |
| ***E04B 1/41*** | (2006.01) |
| *E04B 1/38* | (2006.01) |

(52) U.S. Cl.

CPC ..... *E04B 7/06* (2013.01); *E04B 1/40* (2013.01); *E04B 7/022* (2013.01); *E04B 2001/405* (2013.01)

(58) Field of Classification Search

CPC . E04B 7/06; E04B 1/40; E04B 1/2608; E04B 1/38; E04B 1/2612; E04B 7/022; E04B 2001/405; E04B 2001/2415; Y10T 403/44; F16B 2200/503

USPC ..... 52/704, 712–715

See application file for complete search history.

(56) References Cited

U.S. PATENT DOCUMENTS

| | | | | | |
|---|---|---|---|---|---|
| 1,656,741 | A * | 1/1928 | Lane | E04C 3/02 | 52/695 |
| 2,963,127 | A * | 12/1960 | Manville | E04B 2/56 | 52/693 |
| 2,964,807 | A * | 12/1960 | Kennedy | E04C 3/02 | 52/696 |
| 3,184,800 | A * | 5/1965 | Nelson | E04B 1/2608 | 403/219 |
| 3,229,333 | A * | 1/1966 | Hillesheim | E04B 1/2608 | 403/231 |
| 3,256,030 | A * | 6/1966 | Banse | E04B 1/2608 | 403/400 |
| 3,333,875 | A * | 8/1967 | Tracy | E04B 1/2608 | 403/170 |
| 3,423,898 | A * | 1/1969 | Coloney | E04B 7/063 | 52/713 |
| 3,845,601 | A * | 11/1974 | Kostecky | E04B 1/2403 | 52/290 |

(Continued)

*Primary Examiner* — Brian E Glessner
*Assistant Examiner* — Adam G Barlow

(57) ABSTRACT

A rafter reinforcement bracket apparatus for securing rafters to strengthen a wood frame roof includes a bendable strap configured to conform to a rafter bottom side of a pair of opposing rafters and a beam between the pair of rafters. A left and right bracket are coupled to a strap top side adjacent a strap front edge and a strap back edge, respectively. Each has a perpendicular portion extending perpendicularly from the strap and an upper portion extending perpendicularly from the perpendicular portion and lying in a plane parallel to a plane of the strap. Each of the strap, the left bracket, and the right bracket has a plurality of mounting holes extending therethrough. Each of the mounting holes is configured to receive a fastener to fix the apparatus to the pair of opposing rafters and the beam.

10 Claims, 3 Drawing Sheets

(56) References Cited

U.S. PATENT DOCUMENTS 4,498,801 A * 2/1985 Gilb ..... F16B 9/058 403/232.1
5,004,369 A * 4/1991 Young ..... E04B 1/2612 403/232.1
5,148,890 A * 9/1992 Sipe ..... E04D 15/00 182/222
5,217,317 A * 6/1993 Young ..... F16B 9/058 403/232.1
5,380,116 A * 1/1995 Colonias ..... E04D 12/008 403/232.1
5,457,928 A * 10/1995 Sahnazarian ..... E04B 7/063 52/702
5,606,837 A * 3/1997 Holizlander ..... E04C 3/02 52/639
5,797,694 A * 8/1998 Breivik ..... E04B 7/06 403/231
5,899,042 A * 5/1999 Pellock ..... E04C 3/02 52/696
D436,017 S * 1/2001 Hays ..... D8/354
6,354,055 B1 * 3/2002 Shaw ..... E04B 7/022 52/696
6,418,695 B1 * 7/2002 Daudet ..... E04B 7/022 52/639
6,772,570 B2 8/2004 Horne
6,837,019 B2 * 1/2005 Collie ..... E04B 7/063 52/489.1
6,993,882 B2 * 2/2006 Crawford ..... E04B 7/022 52/696
7,254,919 B2 * 8/2007 Lutz ..... E04B 7/045 52/699
8,061,088 B2 * 11/2011 Walker ..... E04B 7/045 52/92.2
8,615,935 B1 * 12/2013 Calini ..... E04B 7/045 52/92.2
D702,533 S * 4/2014 Noturno ..... E04G 21/1891 D8/354
8,756,895 B1 * 6/2014 Sidhu ..... E04B 7/022 52/696
8,833,030 B2 * 9/2014 Zimmerman ..... F16B 9/058 52/702
9,003,738 B1 * 4/2015 Evans, Jr. ..... E04B 1/40 52/702
9,045,895 B1 6/2015 Lin
9,290,926 B2 * 3/2016 Sidhu ..... E04B 5/12
10,214,897 B2 * 2/2019 Tan ..... E04B 1/2608
10,280,617 B2 * 5/2019 Monty ..... F16B 7/0493
10,329,766 B1 * 6/2019 Kollinger ..... E04C 3/02
2002/0062617 A1 * 5/2002 diGirolamo ..... E04B 2/767 52/688
2002/0124483 A1 * 9/2002 Rosas ..... E04B 1/2608 52/92.2
2004/0206031 A1 * 10/2004 Mow ..... E04B 1/2608 52/459
2005/0202779 A1 9/2005 Smith
2006/0096192 A1 * 5/2006 Daudet ..... E04C 3/07 52/204.1
2007/0022701 A1 * 2/2007 Surowiecki ..... E04B 2/7457 52/693
2009/0151294 A1 * 6/2009 Staley ..... E04B 7/063 52/655.1
2009/0217603 A1 * 9/2009 Brady ..... E04B 2/7457 52/127.1
2011/0146201 A1 * 6/2011 Vanker ..... E04B 1/1903 52/792.1
2012/0272608 A1 * 11/2012 Groenesteyn ..... E04C 5/18 52/657
2014/0311082 A1 * 10/2014 Sidhu ..... E04B 2/706 52/693
2017/0175381 A1 * 6/2017 Wesney ..... E04B 1/40
2017/0298612 A1 * 10/2017 Hildestad ..... E04D 12/008
2018/0320371 A1 * 11/2018 Rotter ..... E04B 1/26

* cited by examiner

RAFTER REINFORCEMENT BRACKET APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to construction brackets and more particularly pertains to a new construction bracket for securing rafters to strengthen a wood frame roof.

BRIEF SUMMARY OF THE INVENTION

An embodiment of the disclosure meets the needs presented above by generally comprising a strap having a strap front edge, a strap back edge, a strap left edge, a strap right edge, a strap top side, and a strap bottom side. The strap has a left portion, a medial portion, and a right portion and is configured to conform to a rafter bottom side of a pair of opposing rafters and a beam between the pair of rafters. The strap is sufficiently bendable to be bent to conform to the pitch of the pair of opposing rafters. A left bracket is coupled to the strap top side adjacent the strap front edge and extending along the left portion to the strap left edge. The left bracket has a left perpendicular portion extending perpendicularly from the strap and a left upper portion extending perpendicularly from the left perpendicular portion and lying in a plane parallel to a plane of the strap. The left perpendicular portion is configured to extend up a rafter front side of the rafter and the left upper portion is configured to extend over a rafter top side of the rafter. A right bracket is coupled to the strap top side adjacent the strap back edge and extending along the right portion to the strap right edge. The right bracket has a right perpendicular portion extending perpendicularly from the strap and a right upper portion extending perpendicularly from the right perpendicular portion and lying in a plane parallel to a plane of the strap. The right perpendicular portion is configured to extend up a rafter back side of the rafter and the right upper portion being configured to extend over the rafter top side of the rafter. Each of the strap, the left bracket, and the right bracket has a plurality of mounting holes extending therethrough. Each of the mounting holes is configured to receive a fastener to fix the apparatus to the pair of opposing rafters and the beam.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
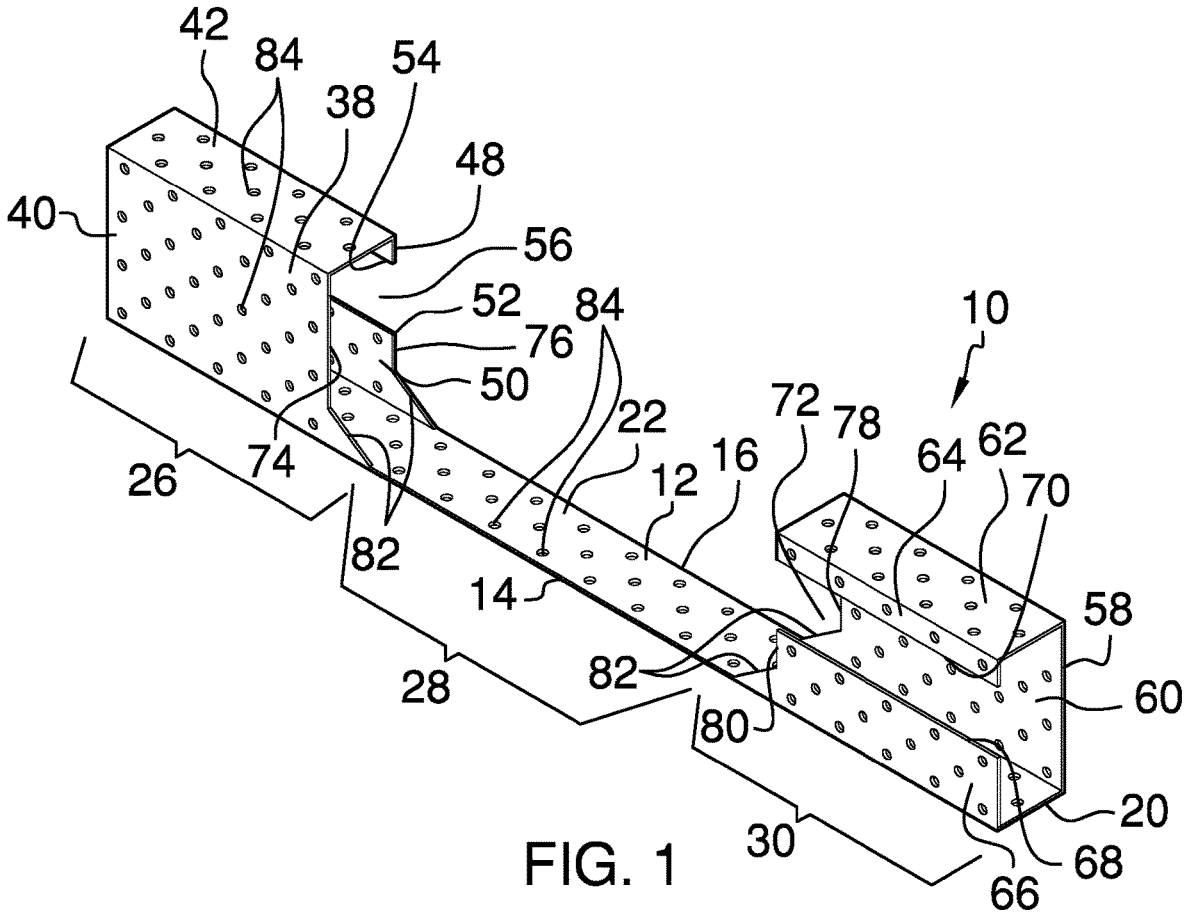
FIG. 1 is an isometric view of a rafter reinforcement bracket apparatus according to an embodiment of the disclosure.
Figure 2:
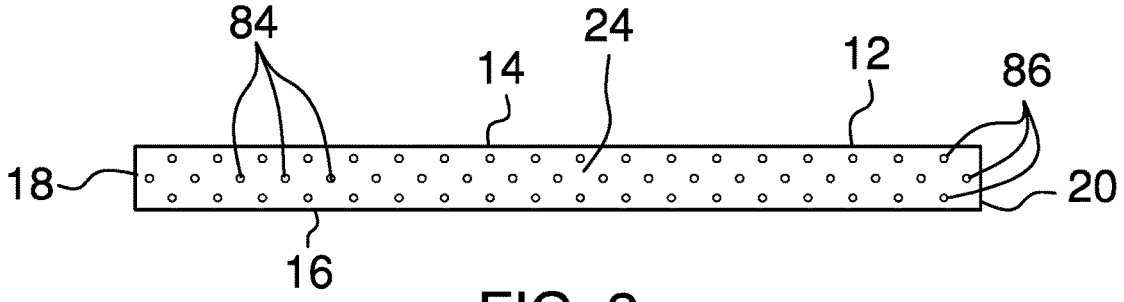
FIG. 2 is a bottom plan view of an embodiment of the disclosure.
Figure 3:
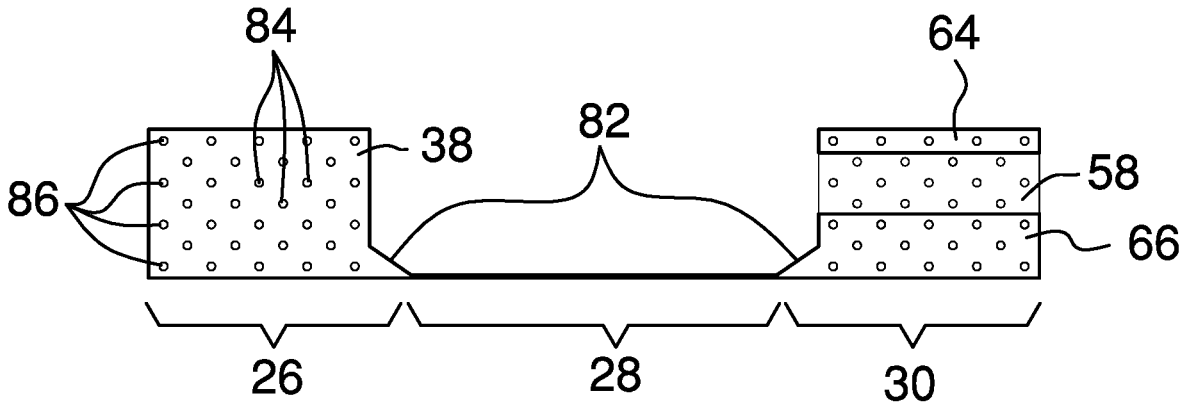
FIG. 3 is a front elevation view of an embodiment of the disclosure.
Figure 4:
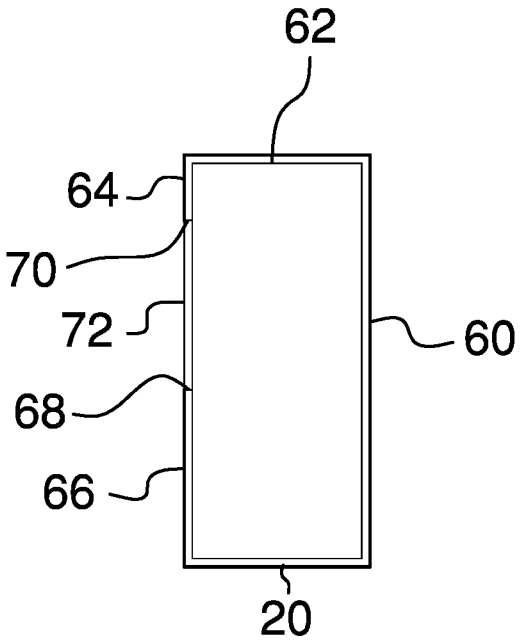
FIG. 4 is a side elevation view of an embodiment of the disclosure.
Figure 5:
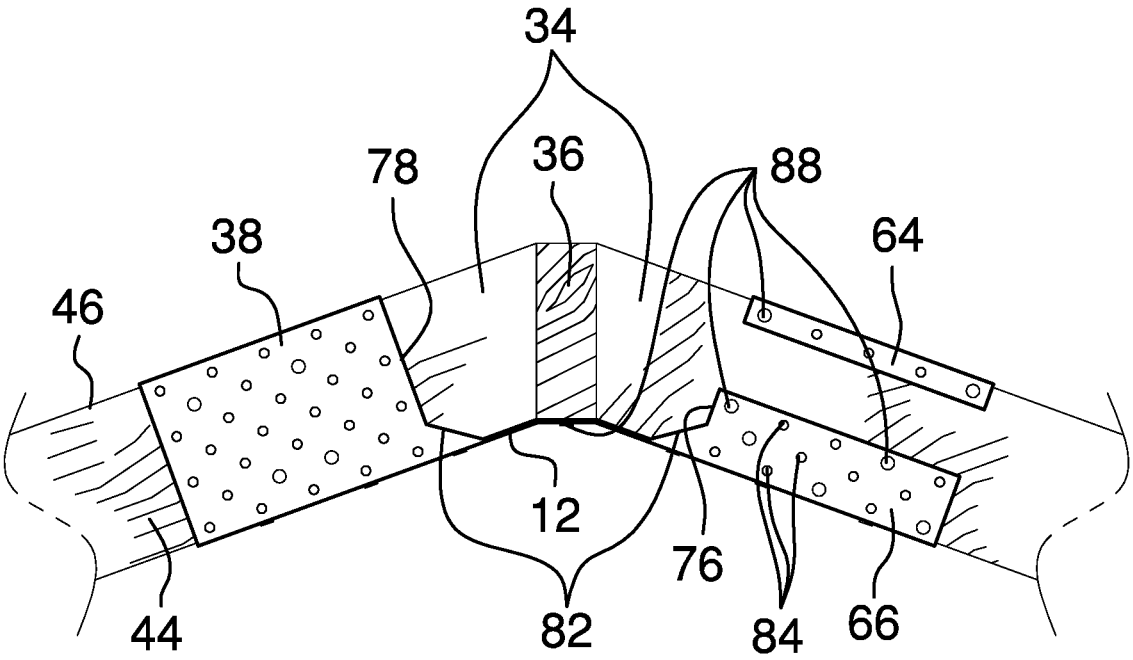
FIG. 5 is an in-use view of an embodiment of the disclosure.

With reference now to the drawings, and in particular to FIGS. 1 through 5 thereof, a new construction bracket embodying the principles and concepts of an embodiment of the disclosure and generally designated by the reference numeral 10 will be described.

As best illustrated in FIGS. 1 through 5, the rafter reinforcement bracket apparatus 10 generally comprises a strap 12 having a strap front edge 14, a strap back edge 16, a strap left edge 18, a strap right edge 20, a strap top side 22, and a strap bottom side 24. The strap 12 has a left portion 26, a medial portion 28, and a right portion 30. The left portion 26 and the right portion 30 have a width less than a width of the medial portion 28. The strap 12 is configured to conform to a rafter bottom side 32 of a pair of opposing rafters 34 and a beam 36 between the pair of rafters 34. The strap 12 is sufficiently bendable to be bent to conform to the pitch of the pair of opposing rafters 34.

A left bracket 38 is coupled to the strap top side 22 adjacent the strap front edge 14 and extends along the left portion 26 to the strap left edge 18. The left bracket 38 has a left perpendicular portion 40 extending perpendicularly from the strap 12 and a left upper portion 42 extending perpendicularly from the left perpendicular portion 40 and lying in a plane parallel to a plane of the strap 12. The left perpendicular portion 40 is configured to extend up a rafter front side 44 of the rafter and the left upper portion 42 is configured to extend over a rafter top side 46 of the rafter. A left overhang portion 48 may extend perpendicularly from the left upper portion 42 towards the strap back edge 16. A left lip 50 is coupled to the strap top side 22 adjacent the strap back edge 16 and extends along the left portion 26 to the strap left edge 18. The left lip 50 lies in a plane coplanar with a plane of the left overhang portion 48. A left lip top edge 52 of the left lip and a left overhang bottom edge 54 of the left overhang portion are parallel and define a left install channel 56. The left bracket 38 is sufficiently bendable to receive the rafter 34 through the left install channel 56.

A right bracket 58 is coupled to the strap top side 22 adjacent the strap back edge 16 and extends along the right portion 30 to the strap right edge 20. The right bracket 58 has a right perpendicular portion 60 extending perpendicularly from the strap 12 and a right upper portion 62 extending perpendicularly from the right perpendicular portion 60 and lying in a plane parallel to a plane of the strap 12. The right perpendicular portion 60 is configured to extend up a rafter back side of the rafter 34 and the right upper portion 62 is configured to extend over the rafter top side 46 of the rafter. A right overhang portion 64 may extend perpendicularly from the right upper portion 62 towards the strap front edge 14. A right lip 66 is coupled to the strap top side 22 adjacent the strap front edge 14 and extends along the right portion 30 to the strap right edge 20. The right lip 66 lies in a plane coplanar with a plane of the right overhang portion 64. A right lip top edge 68 of the right lip and a right overhang bottom edge 70 of the right overhang portion are parallel and defining a right install channel 72. The right bracket 58 is sufficiently bendable to receive the rafter 34 though the right install channel 72. A height of each of the left install channel 56 and the right install channel 72 is less than 50% of a height of each of the left perpendicular portion 40 and the right perpendicular portion 60. Each of a left bracket inner edge 74, a left lip inner edge 76, a right bracket inner edge 78, and a right lip inner edge 80 have an angled portion 82 adjacent the strap top side 22 to increase structural strength. The angled portion 82 has a height less than 25% of the height of each of the left perpendicular portion 40 and the right perpendicular portion 60.

Each of the strap 12, the left bracket 38, the left lip 50, the right bracket 58, and the right lip 66 has a plurality of mounting holes 84 extending therethrough. The plurality of mounting holes 84 may be arranged in a plurality of evenly spaced rows 86 with each row 86 of the plurality of rows offset from the adjacent row 86. Each of the mounting holes 84 is configured to receive a fastener 88 to fix the apparatus 10 to the pair of opposing rafters 34 and the beam 36.

In use, the strap 12, the left bracket 38, the left lip 50, the right bracket 58, and the right lip 66 are bent to accommodate the rafters 34 and then bent again to hug the shape of the rafters 34. The fasteners 88 are then installed through the mounting holes 84 into the rafters 34 and the beam 36 to fix the apparatus 10 and increase the structural integrity of the roof.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A rafter reinforcement bracket apparatus comprising:

a strap, the strap having a strap front edge, a strap back edge, a strap left edge, a strap right edge, a strap top side, and a strap bottom side, the strap having a left portion, a medial portion, and a right portion, the strap being configured to conform to a rafter bottom side of a pair of opposing rafters and a beam between the pair of rafters, the strap being sufficiently bendable to be bent to conform to the pitch of the pair of opposing rafters;

a left bracket coupled to the strap, the left bracket being coupled to the strap top side adjacent the strap front edge and extending along the left portion to the strap left edge, the left bracket having a left perpendicular portion extending perpendicularly from the strap and a left upper portion extending perpendicularly from the left perpendicular portion and lying in a plane parallel to a plane of the strap, the left perpendicular portion being configured to extend up a rafter front side of the rafter and the left upper portion being configured to extend over a rafter top side of the rafter; the left bracket having a left install channel facing a first direction and a right bracket coupled to the strap, the right bracket being coupled to the strap top side adjacent the strap back edge and extending along the right portion to the strap right edge, the right bracket having a right perpendicular portion extending perpendicularly from the strap, a right upper portion extending perpendicularly from the right perpendicular portion and lying in a plane parallel to a plane of the strap, the right perpendicular portion being configured to extend up a rafter back side of the rafter and the right upper portion being configured to extend over the rafter top side of the rafter; the right bracket having a right install channel facing a second direction opposite the first direction wherein each of the strap, the left bracket, and the right bracket has a plurality of mounting holes extending therethrough, each of the mounting holes being configured to receive a fastener to fix the apparatus to the pair of opposing rafters and the beam.

2. The rafter reinforcement bracket apparatus of claim 1 further comprising the left bracket having a left overhang portion extending perpendicularly from the left upper portion towards the strap back edge and the right bracket having a right overhang portion extending perpendicularly from the right upper portion towards the strap front edge, each of the left bracket and the right bracket being sufficiently bendable to receive the rafters.

3. The rafter reinforcement bracket apparatus of claim 2 further comprising a left lip and a right lip, the left lip being coupled to the strap top side adjacent the strap back edge and extending along the left portion to the strap left edge, the left lip lying in a plane coplanar with a plane of the left overhang portion, a left lip top edge of the left lip and a left overhang bottom edge of the left overhang portion defining the left install channel, the right lip being coupled to the strap top side adjacent the strap front edge and extending along the right portion to the strap right edge, the right lip lying in a plane coplanar with a plane of the right overhang portion, a right lip top edge of the right lip and a right overhang bottom edge of the right overhang portion defining the right install channel.

4. The rafter reinforcement bracket apparatus of claim 3 further comprising the left lip top edge and the left overhang portion bottom edge being parallel, the right lip top edge and the right overhang portion bottom edge being parallel.

5. The rafter reinforcement bracket apparatus of claim 3 further comprising a height of each of the left install channel and the right install channel being less than 50% of a height of each of the left perpendicular portion and the right perpendicular portion.

6. The rafter reinforcement bracket apparatus of claim 3 further comprising each of a left bracket inner edge, a left lip inner edge, a right bracket inner edge, and a right lip inner edge having an angled portion adjacent the strap top side.

7. The rafter reinforcement bracket apparatus of claim 6 further comprising the angled portion of each of the left bracket inner edge, the left lip inner edge, the right bracket inner edge, and the right lip inner edge having a height less than 25% of the height of each of the left perpendicular portion and the right perpendicular portion.

8. The rafter reinforcement bracket apparatus of claim 1 further comprising the left portion and the right portion of the strap having a width less than a width of the medial portion.

9. The rafter reinforcement bracket apparatus of claim 1 further comprising the plurality of mounting holes being arranged in a plurality of evenly spaced rows, each row of the plurality of rows being offset from the adjacent row.

10. A rafter reinforcement bracket apparatus comprising:

a strap, the strap having a strap front edge, a strap back edge, a strap left edge, a strap right edge, a strap top side, and a strap bottom side, the strap having a left portion, a medial portion, and a right portion, the left portion and the right portion of the strap having a width less than a width of the medial portion, the strap being configured to conform to a rafter bottom side of a pair of opposing rafters and a beam between the pair of rafters, the strap being sufficiently bendable to be bent to conform to the pitch of the pair of opposing rafters;

a left bracket coupled to the strap, the left bracket being coupled to the strap top side adjacent the strap front edge and extending along the left portion to the strap left edge, the left bracket having a left perpendicular portion extending perpendicularly from the strap and a left upper portion extending perpendicularly from the left perpendicular portion and lying in a plane parallel to a plane of the strap, the left perpendicular portion being configured to extend up a rafter front side of the rafter and the left upper portion being configured to extend over a rafter top side of the rafter, a left overhang portion extending perpendicularly from the left upper portion towards the strap back edge, the left bracket being sufficiently bendable to receive the rafter;

a left lip coupled to the strap, the left lip being coupled to the strap top side adjacent the strap back edge and extending along the left portion to the strap left edge, the left lip lying in a plane coplanar with a plane of the left overhang portion, a left lip top edge of the left lip and a left overhang bottom edge of the left overhang portion being parallel and defining a left install channel;

a right bracket coupled to the strap, the right bracket being coupled to the strap top side adjacent the strap back edge and extending along the right portion to the strap right edge, the right bracket having a right perpendicular portion extending perpendicularly from the strap, a right upper portion extending perpendicularly from the right perpendicular portion and lying in a plane parallel to a plane of the strap, the right perpendicular portion being configured to extend up a rafter back side of the rafter and the right upper portion being configured to extend over the rafter top side of the rafter, a right overhang portion extending perpendicularly from the right upper portion towards the strap front edge, the right bracket being sufficiently bendable to receive the rafters; and a right lip coupled to the strap, the right lip being coupled to the strap top side adjacent the strap front edge and extending along the right portion to the strap right edge, the right lip lying in a plane coplanar with a plane of the right overhang portion, a right lip top edge of the right lip and a right overhang bottom edge of the right overhang portion being parallel and defining a right install channel, a height of each of the left install channel and the right install channel being less than 50% of a height of each of the left perpendicular portion and the right perpendicular portion, each of a left bracket inner edge, a left lip inner edge, a right bracket inner edge, and a right lip inner edge having an angled portion adjacent the strap top side, the angled portion having a height less than 25% of the height of each of the left perpendicular portion and the right perpendicular portion;

wherein each of the strap, the left bracket, the left lip, the right bracket, and the right lip has a plurality of mounting holes extending therethrough, the plurality of mounting holes being arranged in a plurality of evenly spaced rows, each row of the plurality of rows being offset from the adjacent row, each of the mounting holes being configured to receive a fastener to fix the apparatus to the pair of opposing rafters and the beam.

* * * * *